US007434287B1

(12) United States Patent
Borges

(10) Patent No.: US 7,434,287 B1
(45) Date of Patent: Oct. 14, 2008

(54) REMOVABLE WALL-MOUNTED BACK SCRUBBER

(76) Inventor: Misael Borges, 4200 W. 19th Ave., Hialeah, FL (US) 33012

( * ) Notice: Subject to any disclaimer, the term of this patent is extended or adjusted under 35 U.S.C. 154(b) by 0 days.

(21) Appl. No.: 11/607,940

(22) Filed: Dec. 4, 2006

(51) Int. Cl.
*A47K 7/03* (2006.01)

(52) U.S. Cl. ..... 15/104.92; 15/160; 15/210.1; 4/606

(58) Field of Classification Search ..... 15/160, 15/210.1, 104.92; 4/606
See application file for complete search history.

(56) References Cited

U.S. PATENT DOCUMENTS 3,289,215 A * 12/1966 Kennedy ..... 4/606
4,053,960 A * 10/1977 Kingswell ..... 15/104.92
4,417,362 A * 11/1983 Walker ..... 4/606
D344,633 S 3/1994 Ali
D358,258 S * 5/1995 Gingras ..... D4/115
5,684,722 A 11/1997 Thorner et al.
5,774,907 A * 7/1998 Doggwiler ..... 4/606
6,427,279 B1 * 8/2002 White et al. ..... 15/104.92
6,647,564 B1 11/2003 Smith
7,120,947 B1 * 10/2006 Magallanes ..... 4/606
2002/0117185 A1 8/2002 Simon et al.
2004/0068812 A1 4/2004 Chysna
2005/0091779 A1 5/2005 Paterson et al.

* cited by examiner

*Primary Examiner*—Randall Chin

(57) ABSTRACT

A removable wall-mounted back scrubber includes an anchor plate that has planar front and rear surfaces. The plate is vertically attached to a vertical interior surface of a shower stall. The plate has a plurality of equidistantly spaced suction cups coupled thereto. A reservoir is detachably connected to an upper portion of the plate and includes a hollow chamber therein. The reservoir has a longitudinal length substantially equal to a latitudinal length of the cleaning surface. A plurality of discharge outlets is oriented along a bottom surface of the reservoir. A cleaning surface is attached to the front surface of the plate and is juxtaposed orthogonally thereto. The cleaning surface extends orthogonally from the plate and terminates at a distance beyond the discharge outlets.

18 Claims, 4 Drawing Sheets

REMOVABLE WALL-MOUNTED BACK SCRUBBER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to back scrubbers and, more particularly, to a removable wall-mounted back scrubber for cleansing a user's back while showering.

2. Prior Art

Various devices for attachment to a bathroom shower or tub wall presently exist for the purpose of cleaning or massaging inaccessible areas of a person's body, particularly the back. Such devices assist the elderly, persons with arthritis and others with impaired mobility. Otherwise unimpaired persons also benefit from the presently known devices which make hard-to-reach areas of a person accessible to cleaning or massaging.

One prior art example shows a wall-mountable back scrubber comprising a rectangular base unit with adapter mounts and suction cups attached to the rear surface, slots with adjacent tabs in the front surface, and a compartment and soap dish in the top, along with a brush unit with adapter mounts attached to the rear surface, wherein the adapter mounts attached to the brush unit are configured to fit within the slots in the rectangular base unit and be held in place by the tabs. The back scrubber has particular utility in connection with scrubbing with a soothing and massaging effect. Unfortunately, this prior art example does not provide for a liquid soap dispenser attached to the back scrubber to facilitate ease of cleaning of the user's back.

Another prior art example shows a wall mounted back-scrubbing and massaging apparatus that has a wall mounting plate which is bonded to a rubber sheet having a plurality of suction cups, thereby allowing the wall mounting plate to be removably attachable to a wall surface. A sponge mounting box is mounted on the wall mounting plate by a lip. In a first embodiment, the base and the peripheral edge removably engage a sponge. A plurality of outwardly extending fingers integral with the base, penetrate the sponge, further securing the sponge onto the base. The sponge is thus supported in spaced relationship with respect to the wall surface by the sponge mounting box so as to be in a position for convenient scrubbing of a person's skin when brought into contact with the sponge.

In a second embodiment, the mounting box further includes a cover which frictionally engages the sponge mounting box, clamping a flexible lateral apron portion of a rectangular cloth, holding the cloth over the base. The cover and the sponge mounting box further provide drain apertures to allow water to drain from the apparatus. Unfortunately, this prior art example is complicated to assemble and use. Additionally, users with limited use of their hands and fingers may find it difficult to attach the necessary sponge or cloth for cleaning purposes. This prior art example also does not provide for a liquid soap dispenser attached to the back scrubber to facilitate ease of cleaning of the user's back.

Accordingly, a need remains for a removable wall-mounted back scrubber in order to overcome the above-noted shortcomings. The present invention satisfies such a need by providing an apparatus that is simple and easy to use, is lightweight yet durable in design, and allows for the cleaning and scrubbing of a user's back with ease and minimal effort. Such an apparatus is convenient, effective, and time-saving. The present invention is ideal for the elderly, those with arthritis, and disabled individuals who may have limited physical movement. The apparatus is practical, reasonably priced, and attractive.

BRIEF SUMMARY OF THE INVENTION

In view of the foregoing background, it is therefore an object of the present invention to provide an apparatus for a removable wall-mounted back scrubber. These and other objects, features, and advantages of the invention are provided by a removable wall-mounted back scrubber for cleansing a user's back while showering.

The back scrubber conveniently includes a wall-mounted anchor plate that has planar front and rear surfaces. Such an anchor plate is vertically attached to a vertical interior surface of a shower stall. The anchor plate further has a plurality of equidistantly spaced suction cups directly coupled thereto such that the anchor plate is effectively prevented from moving laterally or vertically during operating conditions.

The back scrubber conveniently includes a reservoir detachably connected to an upper portion of the anchor plate. Such a reservoir includes a hollow chamber therein for effectively receiving and housing a predetermined quantity of a disinfecting agent. The reservoir further includes a plurality of equidistantly juxtaposed discharge outlets oriented along a bottom surface of the reservoir such that the disinfecting agent contained therein is advantageously discharged along a uniform vertical path traversing along an entire width of the cleaning surface. The reservoir is spaced from the suction cups and advantageously allows the user to slidably position the anchor plate along the vertical interior surface without prematurely agitating the disinfecting agent housed within the hollow chamber. The reservoir has a longitudinal length substantially equal to a latitudinal length of the cleaning surface.

A cleaning surface is effectively attached to the front surface of the anchor plate and juxtaposed orthogonally thereto. Such a cleaning surface extends orthogonally from the anchor plate and terminates at a distance beyond the discharge outlets such that the disinfecting agent advantageously displaces vertically along a longitudinal length of the cleaning surface and evenly impregnates an entire surface area of the cleaning surface. The cleaning surface preferably is formed from a porous and deformably resilient material. The cleaning surface also preferably is permanently attached to a front surface of the anchor plate The apparatus includes a plurality of suction cups that are directly connected to the rear surface of the anchor plate and extend rearwardly therefrom. Such a plurality of suction cups contacts the vertical interior surface of the shower stall. The suction cups are coextensively shaped for effectively providing uniform adhesion during operating conditions.

The apparatus includes a reservoir that includes a threaded inlet monolithically formed in a top surface of the reservoir and extending upwardly therefrom such that a quantity of disinfecting agent can be conveniently introduced into the hollow chamber therein. A threaded cap is removably mated to the inlet such that the disinfecting agent contained within the hollow chamber is effectively prevented from escaping the hollow chamber. Such a cap is centrally registered along a longitudinal length of the reservoir for equally discharging the disinfecting agent through an entire surface area of the hollow chamber.

A plurality of equidistantly juxtaposed discharge outlets is oriented along a bottom surface of the reservoir such that the disinfecting agent contained therein is advantageously discharged along a uniform vertical path traversing along an entire width of the cleaning surface. Such a reservoir has a front face effectively terminating beyond the front surface of the anchor plate. The discharge outlets are spaced forwardly from the anchor plate and above the cleaning surface respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
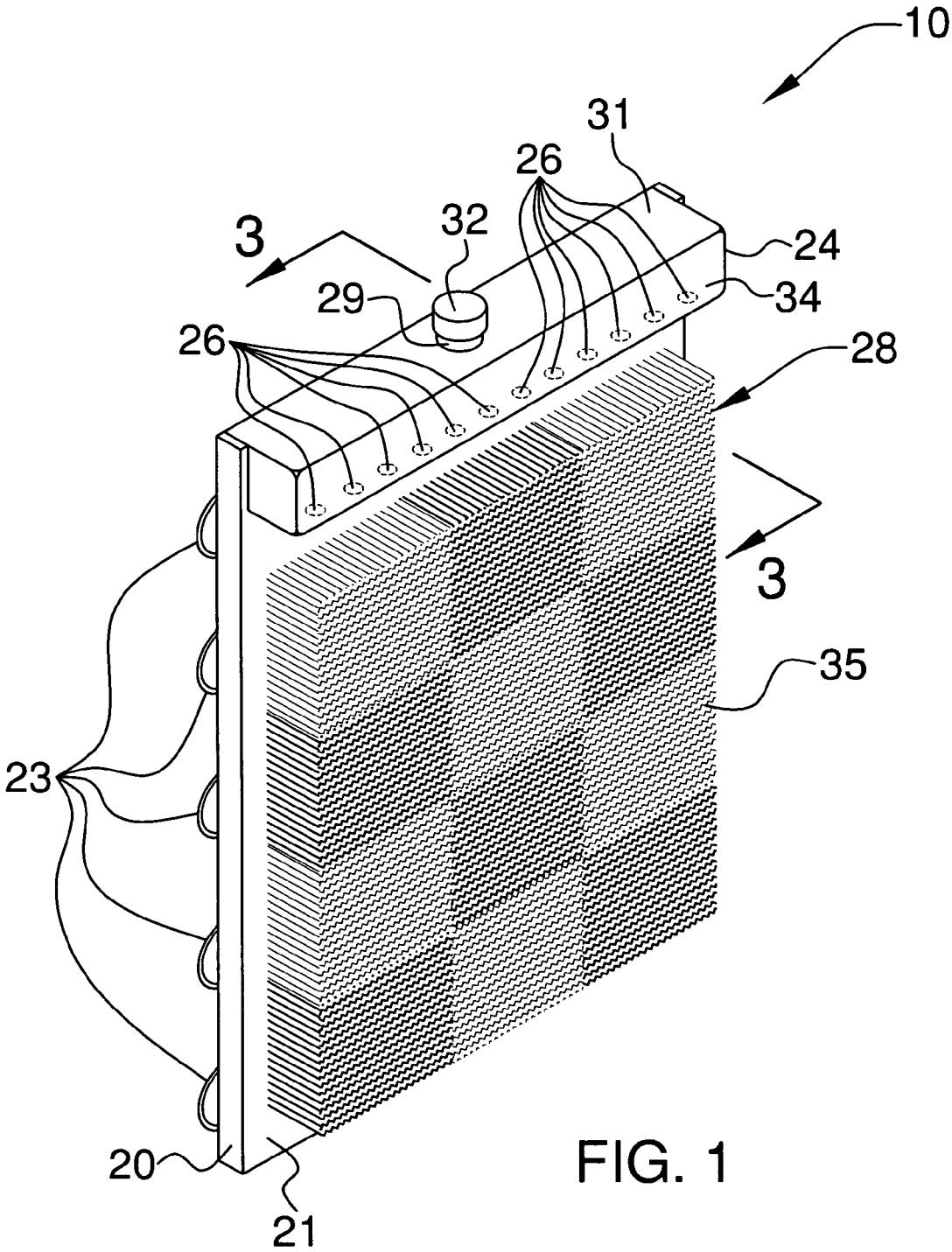
FIG. 1 is a perspective view showing a removable wall-mounted back scrubber, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures. Prime and double prime notations refer to alternate embodiments of like elements.

The apparatus of this invention is referred to generally in FIGS. 1-5 by the reference numerals 10, 10' and 10" and is intended to provide a removable wall-mounted back scrubber. It should be understood that the apparatus 10, 10' and 10" may be used to scrub many different types of body parts, and should not be limited in use to only scrubbing a user's back.

Referring initially to FIGS. 1, 2, 3, 4 and 5, the apparatus 10, 10' and 10" conveniently includes a wall-mounted anchor plate 20 that has planar front 21 and rear 22 surfaces. Such an anchor plate 20 is vertically attached to a vertical interior surface 11 of a shower stall 12. The anchor plate 20 has a plurality of equidistantly spaced suction cups 23 directly coupled thereto, without the use of intervening elements, which is vital such that the anchor plate 20 is effectively prevented from moving laterally or vertically during operating conditions.

Again referring to FIGS. 1-5, the apparatus 10, 10' and 10" conveniently includes a reservoir 24 detachably connected to an upper portion of the anchor plate 20. Such a reservoir 24 includes a hollow chamber 25 therein for effectively receiving and housing a predetermined quantity of a disinfecting agent 36. Of course, a variety of suitable disinfecting agents 36 may be used, as is obvious to a person of ordinary skill in the art. The reservoir 24 further includes a plurality of equidistantly juxtaposed discharge outlets 26 advantageously oriented along a bottom surface 27 of the reservoir 24, which is crucial such that the disinfecting agent 36 contained therein is advantageously discharged along a uniform vertical path traversing along an entire width of the cleaning surface 28.

Yet again referring to FIGS. 1-5, the reservoir 24 is spaced from the suction cups 23, which advantageously allows the user to slidably position the anchor plate 20 along the vertical interior surface 11 without prematurely agitating the disinfecting agent 36 housed within the hollow chamber 25. The reservoir 24 has a longitudinal length substantially equal to a latitudinal length of the cleaning surface 28, which overcomes prior art shortcomings of not uniformly discharging the disinfecting agent 36 over an entire surface area of the cleansing surface 28 (described hereinbelow).

Still referring to FIGS. 1-5, the apparatus 10, 10' and 10" includes a cleaning surface 28 that is effectively attached to the front surface 21 of the anchor plate 20 and juxtaposed orthogonally thereto. Such a cleaning surface 28 extends orthogonally from the anchor plate 20 and terminates at a distance beyond the discharge outlets 26, which is essential such that the disinfecting agent 36 advantageously displaces vertically along a longitudinal length of the cleaning surface 28 and evenly impregnates an entire surface area of the cleaning surface 28. The cleaning surface 28 is formed from a porous and deformably resilient material. Of course, such a cleaning surface 28 can be formed from a variety of suitably porous and deformably resilient materials, as is obvious to a person of ordinary skill in the art. The cleaning surface 28 is also directly attached to a front surface 21 of the anchor plate 20, without the use of intervening elements.

Figure 2:
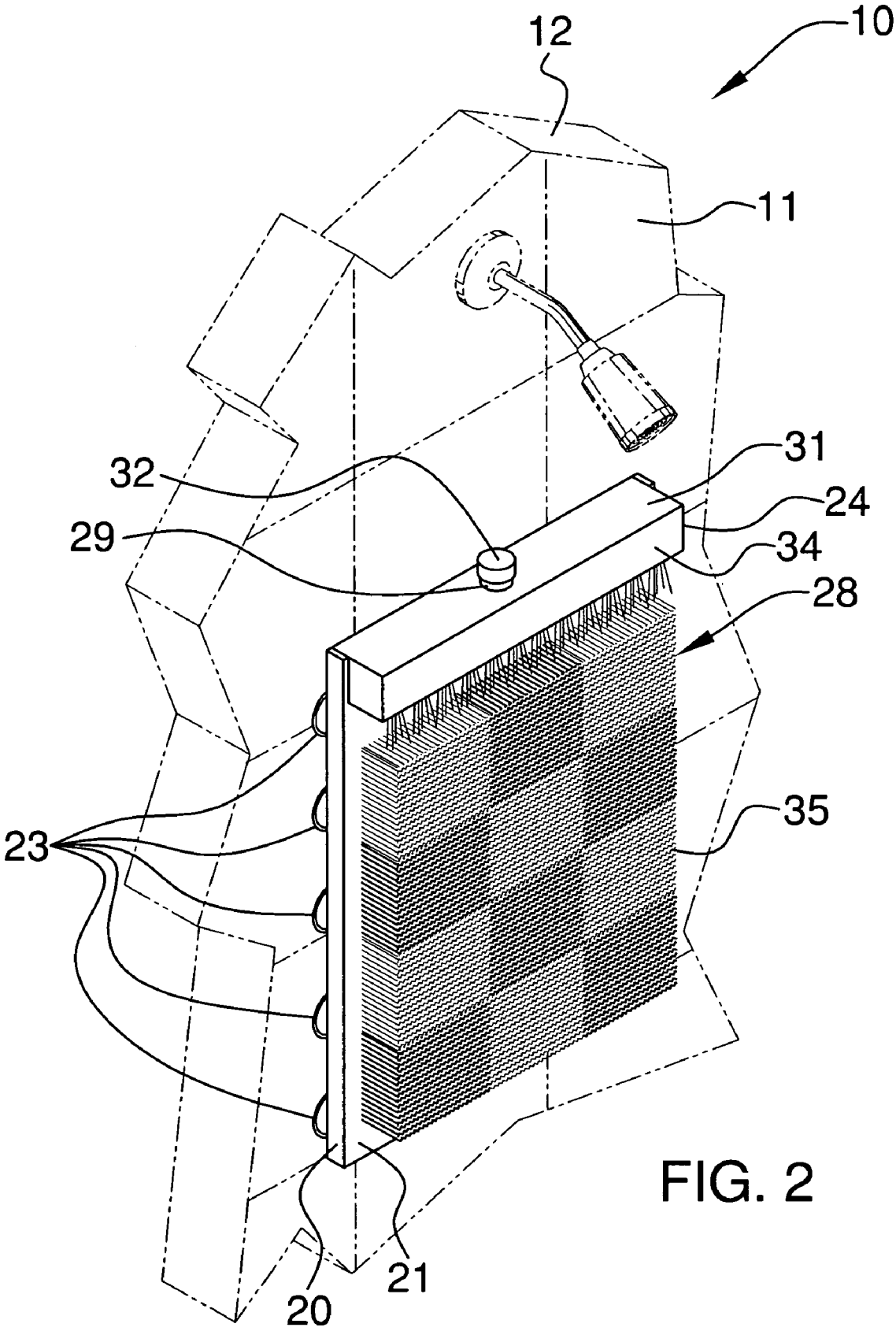
FIG. 2 is a perspective view of the apparatus shown in FIG. 1 showing the apparatus attached to an interior surface of a shower stall.
Figure 3:
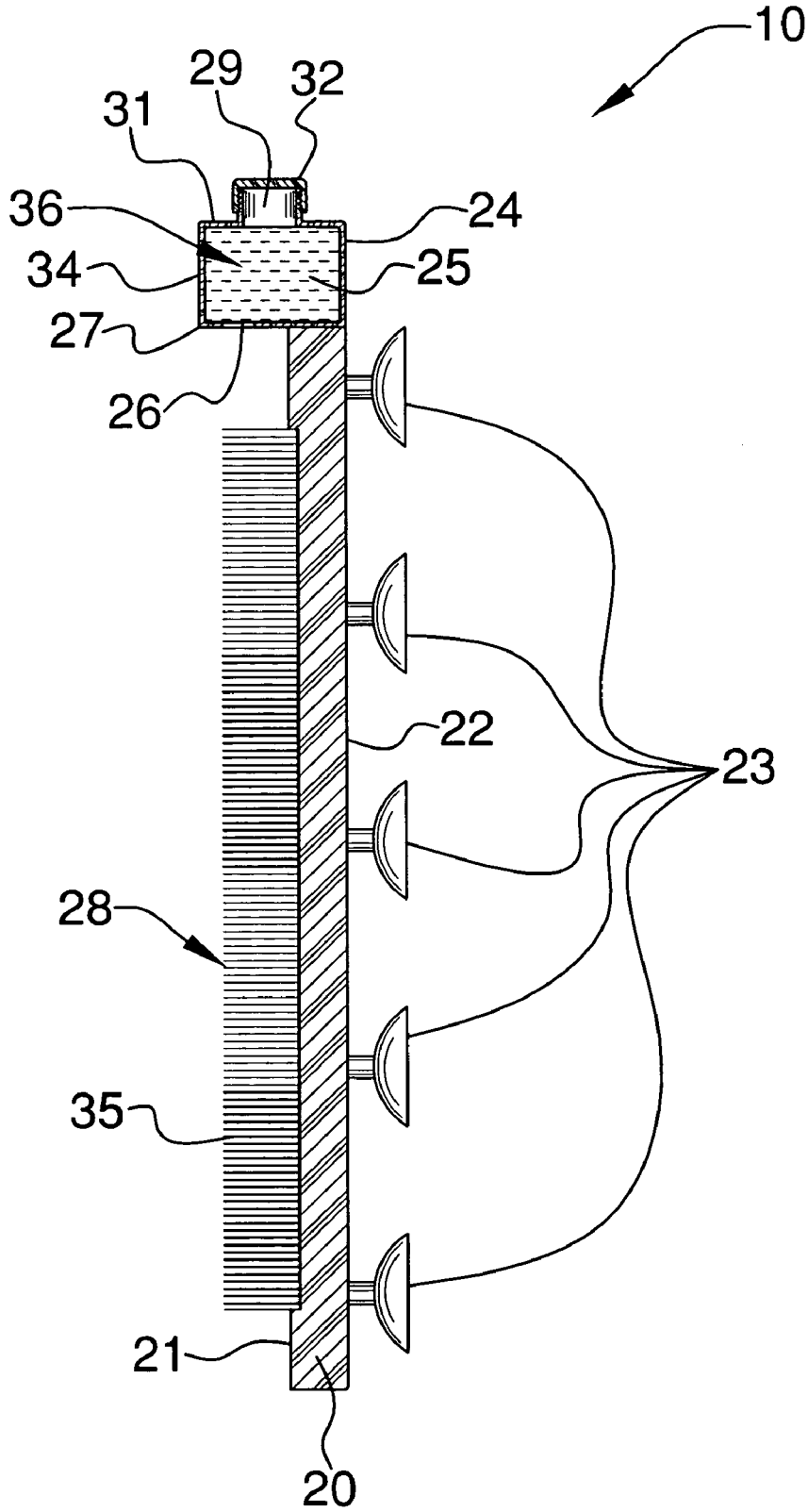
FIG. 3 is a cross-sectional view of the apparatus shown in FIG. 1 taken along line 3-3.

Referring to FIGS. 1, 2 and 3 the apparatus 10 includes a plurality of suction cups 23 that are directly connected to the rear surface 22 of the anchor plate 20, without the use of intervening elements, and extend rearwardly therefrom. Such a plurality of suction cups 23 contacts the vertical interior surface 11 of the shower stall 12. The suction cups 23 are coextensively shaped, which is critical for effectively providing uniform adhesion during operating conditions. Of course, such suction cups 23 can be produced in a variety of sizes, as is obvious to a person of ordinary skill in the art.

Still again referring to FIGS. 1-5, the apparatus 10, 10' and 10", includes a reservoir 24 that includes a threaded inlet 29 monolithically formed in a top surface 31 of the reservoir 24 and extending upwardly therefrom, which is important such that a quantity of disinfecting agent 36 can be conveniently introduced into the hollow chamber 25 therein. A threaded cap 32 is removably mated to the inlet 29, which is essential such that the disinfecting agent 36 contained within the hollow chamber 25 is effectively prevented from escaping the hollow chamber 25. Such a cap 32 is centrally registered along a longitudinal length of the reservoir 24, which is crucial for equally discharging the disinfecting agent 36 through an entire surface area of the hollow chamber 25.

Yet still again referring to FIGS. 1-5, a plurality of equidistantly juxtaposed discharge outlets 26 is oriented along a bottom surface 27 of the reservoir 24 such that the disinfecting agent 36 contained therein is advantageously discharged along a uniform vertical path traversing along an entire width of the cleaning surface 28. Such a reservoir 24 has a front face 34 effectively terminating beyond the front surface 21 of the anchor plate 20. The discharge outlets 26 are spaced forwardly from the anchor plate 20 and above the cleaning surface 28 respectively, which is essential for allowing the disinfecting agent 36 to be uniformly applied to the cleaning surface 28.

Again referring to FIGS. 1, 2 and 3, in a preferred embodiment, the apparatus 10 includes a cleaning surface 28 formed from brush-like material. Such brush-like material includes deformably resilient bristles 35 directly attached to the front surface 21 of the anchor plate 20, without the use of intervening elements. Of course, such bristles 35 can be produced from a variety of suitable deformably resilient material, as is obvious to a person of ordinary skill in the art. Such bristles 35 are equidistantly spaced and juxtaposed to front surface 21 of the anchor plate 20 and effectively extend orthogonally therefrom and terminate at a distance beyond the discharge outlets 26, which is vital for allowing the disinfecting agent 36 to be uniformly applied to the cleaning surface 28. If the bristles 35 terminated before the discharging outlets 26, the disinfecting agent 36 would merely pass adjacent to the bristles 35 and not permeate therethrough.

Figure 4:
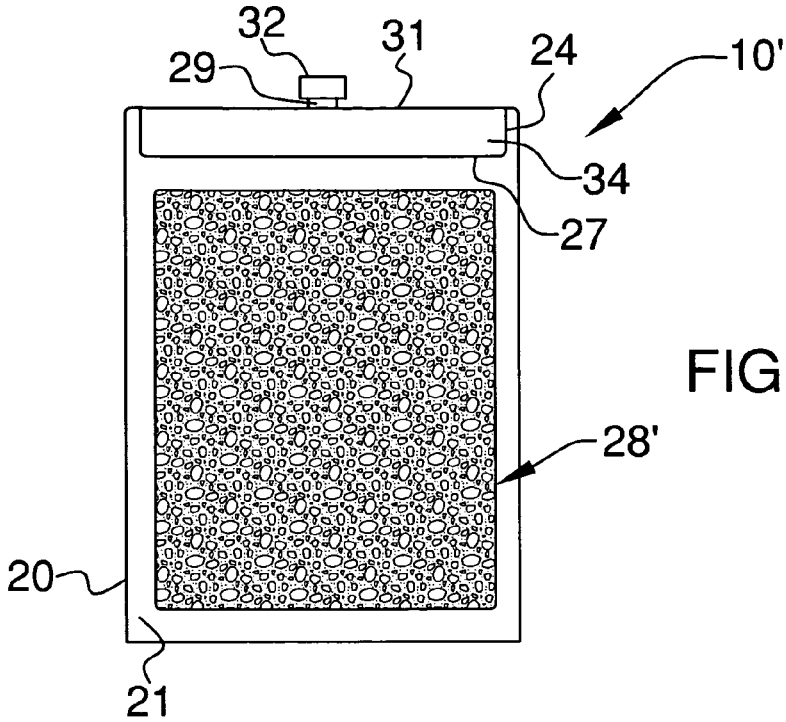
FIG. 4 is a front elevational view showing an alternate embodiment of the cleaning surface.

Referring to FIG. 4, in an alternate embodiment, the apparatus 10' includes a cleaning surface 28' formed from a sponge-like material. Of course, such a cleaning surface 28' can be produced from a variety of suitable sponge-like materials, as is obvious to a person of ordinary skill in the art. The cleaning surface 28' is directly attached to the front surface 21 of the anchor plate 20, without the use of intervening elements, and effectively extends orthogonally therefrom and terminates at a distance beyond the discharge outlets 26, which is vital for allowing the disinfecting agent 36 to be uniformly applied to the cleaning surface 28'.

Figure 5:
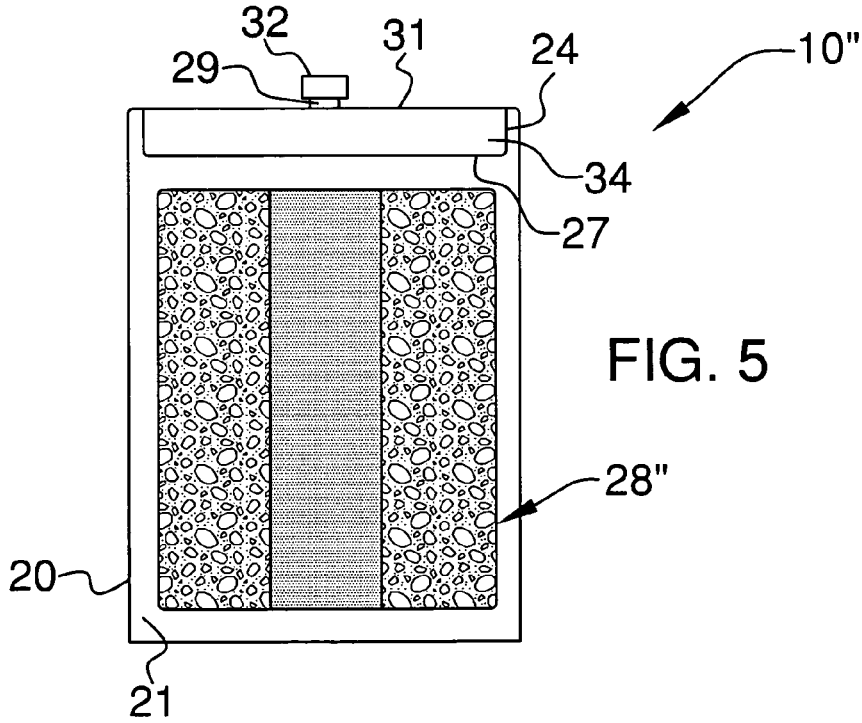
FIG. 5 is a front elevational view showing another embodiment of the cleaning surface.

Referring to FIG. 5, in another embodiment, the apparatus 10" includes a cleaning surface 28" that combines a brush-like material and a sponge-like material respectively. Of course, such a brush-like material and a sponge-like material can be produced in a variety of combinations. The cleaning surface 28" is directly attached to the front surface 21 of the anchor plate 20, without the use of intervening elements, and effectively extends orthogonally therefrom and terminates at a distance beyond the discharge outlets 26, which is vital for allowing the disinfecting agent 36 to be uniformly applied to the cleaning surface 28". The brush-like material critically has a longitudinal length extending along an entire longitudinal length of the cleaning surface 28" for effectively engaging a maximum surface area of the user's body during cleaning operations.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

The invention claimed is:

1. A removable wall-mounted back scrubber for cleansing a user's back while showering, said back scrubber comprising:

a wall-mounted anchor plate, said anchor plate having planar front and rear surfaces, said anchor plate being vertically attached to a vertical interior surface of a shower stall, said anchor plate further having a plurality of equidistantly spaced suction cups directly coupled thereto such that said anchor plate is prevented from moving laterally or vertically during operating conditions;

a cleaning surface attached to said front surface of said anchor plate and juxtaposed orthogonally thereto;

a reservoir detachably connected to an upper portion of said anchor plate, said reservoir including a hollow chamber therein for receiving and housing a predetermined quantity of a disinfecting agent, said reservoir including a plurality of equidistantly juxtaposed discharge outlets oriented along a bottom surface of said reservoir such that said disinfecting agent contained therein is discharged along a uniform vertical path traversing along an entire width of said cleaning surface; and wherein said cleaning surface extends orthogonally from said anchor plate and terminates at a distance beyond said discharge outlets such that said disinfecting agent displaces vertically along a longitudinal length of said cleaning surface and evenly impregnates an entire surface area of said cleaning surface wherein said cleaning surface is directly coupled to said anchor plate and begins at a location disposed anterior of said rear surface of said anchor plate;

wherein said reservoir has a planar top surface registered parallel to a top surface of said anchor plate, said reservoir top surface having a rear edge beginning at said rear surface of said anchor plate and extending forwardly along a linear path wherein a front edge of said reservoir top surface terminates anterior of said front surface of said anchor plate, said reservoir top surface extending along an entire longitudinal length of said reservoir and remaining disposed above said top surface of said anchor plate, wherein said cleaning surface is directly coupled to said anchor plate and begins at a location disposed anterior of said rear surface of said anchor plate.

2. The back scrubber of claim 1, wherein said suction cups are directly connected to said rear surface of said anchor plate and extend rearwardly therefrom, said plurality of suction cups contacting the vertical interior surface of the shower stall, said suction cups being coextensively shaped for providing uniform adhesion during operating conditions.

3. The back scrubber of claim 1, wherein said reservoir further comprises:

a threaded inlet monolithically formed in a top surface of said reservoir and extending upwardly therefrom such that a quantity of disinfecting agent can be introduced into said hollow chamber therein; and a threaded cap removably mated to said inlet such that said disinfecting agent contained within said hollow chamber is prevented from escaping said hollow chamber, said cap being centrally registered along a longitudinal length of said reservoir for equally discharging said disinfecting agent through an entire surface area of said hollow chamber.

4. The back scrubber of claim 1, wherein said reservoir has a front face terminating beyond said front surface of said anchor plate, said discharge outlets being spaced forwardly from said anchor plate and above said cleaning surface respectively.

5. The back scrubber of claim 1, wherein said cleaning surface is formed from a porous and deformably resilient material.

6. The back scrubber of claim 1, wherein said cleaning surface is permanently attached to a front surface of said anchor plate.

7. A removable wall-mounted back scrubber for cleansing a user's back while showering, said back scrubber comprising:

a wall-mounted anchor plate, said anchor plate having planar front and rear surfaces, said anchor plate being vertically attached to a vertical interior surface of a shower stall, said anchor plate further having a plurality of equidistantly spaced suction cups directly coupled thereto such that said anchor plate is prevented from moving laterally or vertically during operating conditions;

a cleaning surface attached to said front surface of said anchor plate and juxtaposed orthogonally thereto;

a reservoir detachably connected to an upper portion of said anchor plate, said reservoir including a hollow chamber therein for receiving and housing a predetermined quantity of a disinfecting agent, said reservoir including a plurality of equidistantly juxtaposed discharge outlets oriented along a bottom surface of said reservoir such that said disinfecting agent contained therein is discharged along a uniform vertical path traversing along an entire width of said cleaning surface, wherein said reservoir is spaced from said suction cups for allowing the user to slidably position said anchor plate along the vertical interior surface without prematurely agitating said disinfecting agent housed within said hollow chamber; and wherein said cleaning surface extends orthogonally from said anchor plate and terminates at a distance beyond said discharge outlets such that said disinfecting agent displaces vertically along a longitudinal length of said cleaning surface and evenly impregnates an entire surface area of said cleaning surface, wherein said cleaning surface is directly coupled to said anchor plate and begins at a location disposed anterior of said rear surface of said anchor plate;

wherein said reservoir has a planar top surface registered parallel to a top surface of said anchor plate, said reservoir top surface having a rear edge beginning at said rear surface of said anchor plate and extending forwardly along a linear path wherein a front edge of said reservoir top surface terminates anterior of said front surface of said anchor plate, said reservoir top surface extending along an entire longitudinal length of said reservoir and remaining disposed above said top surface of said anchor plate.

8. The back scrubber of claim 7, wherein said suction cups are directly connected to said rear surface of said anchor plate and extend rearwardly therefrom, said plurality of suction cups contacting the vertical interior surface of the shower stall, said suction cups being coextensively shaped for providing uniform adhesion during operating conditions.

9. The back scrubber of claim 7, wherein said reservoir further comprises:

a threaded inlet monolithically formed in a top surface of said reservoir and extending upwardly therefrom such that a quantity of disinfecting agent can be introduced into said hollow chamber therein; and a threaded cap removably mated to said inlet such that said disinfecting agent contained within said hollow chamber is prevented from escaping said hollow chamber, said cap being centrally registered along a longitudinal length of said reservoir for equally discharging said disinfecting agent through an entire surface area of said hollow chamber.

10. The back scrubber of claim 7, wherein said reservoir has a front face terminating beyond said front surface of said anchor plate, said discharge outlets being spaced forwardly from said anchor plate and above said cleaning surface respectively.

11. The back scrubber of claim 7, wherein said cleaning surface is formed from a porous and deformably resilient material.

12. The back scrubber of claim 7, wherein said cleaning surface is permanently attached to a front surface of said anchor plate.

13. A removable wall-mounted back scrubber for cleansing a user's back while showering, said back scrubber comprising:

a wall-mounted anchor plate, said anchor plate having planar front and rear surfaces, said anchor plate being vertically attached to a vertical interior surface of a shower stall, said anchor plate further having a plurality of equidistantly spaced suction cups directly coupled thereto such that said anchor plate is prevented from moving laterally or vertically during operating conditions;

a cleaning surface attached to said front surface of said anchor plate and juxtaposed orthogonally thereto;

a reservoir detachably connected to an upper portion of said anchor plate, said reservoir including a hollow chamber therein for receiving and housing a predetermined quantity of a disinfecting agent, said reservoir including a plurality of equidistantly juxtaposed discharge outlets oriented along a bottom surface of said reservoir such that said disinfecting agent contained therein is discharged along a uniform vertical path traversing along an entire width of said cleaning surface, wherein said reservoir is spaced from said suction cups for allowing the user to slidably position said anchor plate along the vertical interior surface without prematurely agitating said disinfecting agent housed within said hollow chamber, wherein said reservoir has a longitudinal length substantially equal to a latitudinal length of said cleaning surface; and wherein said cleaning surface extends orthogonally from said anchor plate and terminates at a distance beyond said discharge outlets such that said disinfecting agent displaces vertically along a longitudinal length of said cleaning surface and evenly impregnates an entire surface area of said cleaning surface, wherein said cleaning surface is directly coupled to said anchor plate and begins at a location disposed anterior of said rear surface of said anchor plate;

wherein said reservoir has a planar top surface registered parallel to a top surface of said anchor plate, said reservoir top surface having a rear edge beginning at said rear surface of said anchor plate and extending forwardly along a linear path wherein a front edge of said reservoir top surface terminates anterior of said front surface of said anchor plate, said reservoir top surface extending along an entire longitudinal length of said reservoir and remaining disposed above said top surface of said anchor plate.

14. The back scrubber of claim 13, wherein said suction cups are directly connected to said rear surface of said anchor plate and extend rearwardly therefrom, said plurality of suction cups contacting the vertical interior surface of the shower stall, said suction cups being coextensively shaped for providing uniform adhesion during operating conditions.

15. The back scrubber of claim 13, wherein said reservoir further comprises:

a threaded inlet monolithically formed in a top surface of said reservoir and extending upwardly therefrom such that a quantity of disinfecting agent can be introduced into said hollow chamber therein; and a threaded cap removably mated to said inlet such that said disinfecting agent contained within said hollow chamber is prevented from escaping said hollow chamber, said cap being centrally registered along a longitudinal length of said reservoir for equally discharging said disinfecting agent through an entire surface area of said hollow chamber.

16. The back scrubber of claim 13, wherein said reservoir has a front face terminating beyond said front surface of said anchor plate, said discharge outlets being spaced forwardly from said anchor plate and above said cleaning surface respectively.

17. The back scrubber of claim 13, wherein said cleaning surface is formed from a porous and deformably resilient material.

18. The back scrubber of claim 13, wherein said cleaning surface is permanently attached to a front surface of said anchor plate.

* * * * *